US010132071B1

(12) United States Patent
Alvarado et al.

(10) Patent No.: US 10,132,071 B1
(45) Date of Patent: Nov. 20, 2018

(54) MODULAR CONNECTOR PIPE SCREEN

(71) Applicant: G2 Construction, Inc., Santa Ana, CA (US)

(72) Inventors: John R. Alvarado, Santa Ana, CA (US); Eric H. Taylor, Huntington Beach, CA (US)

( * ) Notice: Subject to any disclaimer, the term of this patent is extended or adjusted under 35 U.S.C. 154(b) by 96 days.

(21) Appl. No.: 15/289,758

(22) Filed: Oct. 10, 2016

Related U.S. Application Data

(60) Provisional application No. 62/240,973, filed on Oct. 13, 2015.

(51) Int. Cl.
*E03F 5/04* (2006.01)
*E03F 5/06* (2006.01)
*E03F 5/14* (2006.01)

(52) U.S. Cl.
CPC ..... *E03F 5/06* (2013.01); *E03F 5/0404* (2013.01); *E03F 5/14* (2013.01)

(58) Field of Classification Search
CPC ... E03F 1/00; E03F 5/04; E03F 5/0404; E03F 5/14
USPC ..... 210/162, 170.03, 747.3
See application file for complete search history.

(56) References Cited

U.S. PATENT DOCUMENTS 4,909,929 A 3/1990 Tabor
5,405,539 A 4/1995 Schneider
6,797,162 B2 9/2004 Happel
7,276,156 B2 * 10/2007 Lockerman ..... E03F 5/0404 210/170.03
7,494,585 B2 2/2009 Nino
7,722,763 B2 * 5/2010 Benty ..... B01D 21/0012 210/170.03
7,981,283 B2 7/2011 Happel
8,366,923 B1 2/2013 Happel
8,663,466 B2 * 3/2014 Braunwarth ..... E03F 5/14 210/170.03
8,887,922 B2 11/2014 Lilly
2008/0035570 A1 * 2/2008 Lugo ..... E03F 5/0404 210/650
2013/0008842 A1 * 1/2013 Jarvis, Jr. ..... E03F 5/0404 210/232
2013/0008851 A1 * 1/2013 Jarvis, Jr. ..... E03F 5/0404 210/499

(Continued)

*Primary Examiner* — Christopher Upton
(74) *Attorney, Agent, or Firm* — Creativenture Law, LLC; Dennis J M Donahue, III; Kevin C. Staed

(57) ABSTRACT

The present invention comprises a modular connector pipe screen for a catch basin having a plurality of screen segments and a deflector screen. The screen segments may be stacked and adjoined side-by-side wherein the segments are secured together with only fasteners and without any separate frame structure for connection or support. Accordingly, each screen segment is comprised of a single perforated panel having a bottom flange, and at least one of an upper flange, and a side flange which provide integrated structure support as well as surfaces to which the single segments can be fixed together. When stacked, the bottom flange of a first screen segment may be connected to the upper flange of a second screen segment through a fastener or screen segments may be adjoined side-by-side and fastened at the side flanges. Additional screen segments may then be added to create different shapes for various installation needs.

20 Claims, 9 Drawing Sheets

(56) References Cited

U.S. PATENT DOCUMENTS

| | | | | |
|---|---|---|---|---|
| 2013/0043171 | A1* | 2/2013 | Khalil | E03F 5/0404 210/155 |
| 2015/0259896 | A1* | 9/2015 | Jarvis | E03F 5/0404 210/131 |
| 2015/0345523 | A1* | 12/2015 | Hoff | E03F 5/14 210/170.03 |

* cited by examiner

MODULAR CONNECTOR PIPE SCREEN

CROSS-REFERENCE TO RELATED APPLICATIONS

This application claims priority to U.S. Provisional Patent Application Ser. No. 62/240,973 filed on Oct. 13, 2015, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to screens for storm drains and other drainage catch basins, and more particularly to screens that are produced in a modular form and assembled on site around connector pipes within catch basins.

Related Art

Prior art connector pipe screens have typically been produced using sheets of perforated screen material that form multiple panel sections and which must be connected to a separate framework using fasteners. The currently known connector pipe screen systems require the framework for structural support, which can be seen in the prior art drawings shown in FIGS. 1A and 1B. These known framed screen systems do not provide for a modular arrangement of prefabricated screen segments which can be connected together using standard fasteners and without the need for any framework. Since modular prefabricated screen segments can be assembled without creating any separate framework, the modular systems can be assembled faster. The current framed screen systems, including those shown in FIG. 1, increase the installation time which increases the overall cost for the screen systems as compared with modular screen systems. Additionally, the lack of self-supporting screen segments and the need for a separate skeletal structure in current framed screen systems leads to increased material costs. Further, current framed screen systems do not allow for the stacking of prefabricated screen segments nor do they provide for modular variable-angle connectors that can be used with prefabricated screen segments to create different shapes for various installation needs.

SUMMARY OF THE INVENTION

The present invention is a modular connector pipe screen for a catch basin which has multiple screen segments and may also have a top deflector screen. The screen segments are modular because they can be stacked on top of each other and adjoined side-by-side. The stacked or adjoined segments can then be secured together with only fasteners and without any separate frame structure to connect or support them. Accordingly, each screen segment is preferably formed from a single perforated panel with a bottom flange, an upper flange, and a side flange which provide integrated structural support as well as surfaces to which the screen segments can be mounted together. When multiple screen segments are combined, the bottom flange of one screen segment is connected to the upper flange of another screen segment using fasteners. Additional screen segments may then be added to create different shapes for various installation needs. As indicated in more detail below, the screen segments can also be fitted together in an adjoining manner (i.e., a side-by-side arrangement) as well as the stacked arrangement, and no frame is required for these adjoined screen segments.

Another aspect of the present invention is the deflector screen mounted above the connector pipe screen's upper screen segment. The perforated screen segments permit the flow of water into the drainage pipes while blocking debris in the flow, and the deflector screen helps to prevent debris from entering the connector pipe screen's interior space from the top while allowing water to flow through its perforations. The deflector screen can also be formed from a single perforated screen that is self-supporting without any separate skeletal structure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are described in the detailed description below.

DETAILED DESCRIPTION OF THE PREFERRED EMBODIMENTS

Figure 1B:
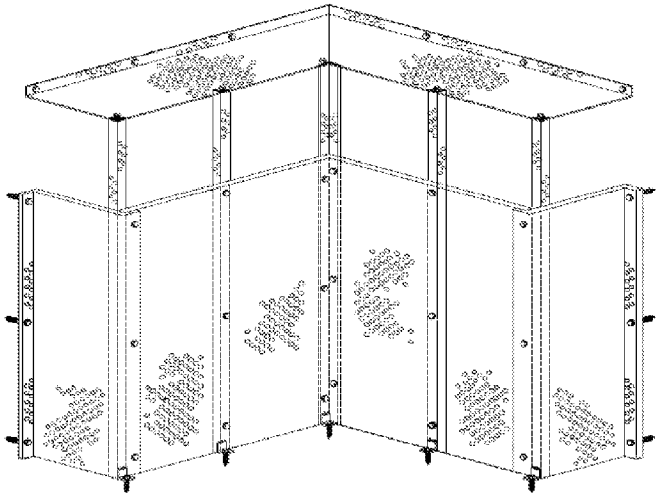
FIG. 1B PRIOR ART
FIGS. 1A and 1B illustrate two types of prior art catch basin screens having a skeletal support structure.

The following description of the preferred embodiment(s) is merely exemplary in nature and is in no way intended to limit the invention, its application, or uses.

As generally shown in FIGS. 2-6, a modular connector pipe screen 10 for a catch basin 150 uses one or more screen segments 12 formed from a single piece of perforated 34 screen panel 26, 80 which may be bent, curved or straight. Regardless of the configuration of the modular connector pipe screen, the modular screen segments 12 of the present invention preferably have a top flange 48, 76 and bottom flange 46, 78 respectively formed on the top side 28 and bottom side 30 of the perforated 34 screen panels 26, 80, and side flanges 50, 74 formed on the side edges of each perforated 34 screen panel 26, 80. The top flange 48, 76 and bottom flange 46, 78 are bent inwardly toward an interior space 14 between the screen panels 12 and the catch basin walls 150*b*, and the side flanges 50, 74 are bent outwardly away from the interior space 14.

In the preferred embodiment, the pipe screen 10 is modular because the individual screen segments 12 are stacked or adjoined to make the preferred pipe screen shape, which is typically dependent on the shape of the catch basin 150. When multiple screen segments 82 are combined, the top flange 48 of the lower screen segment 12*a* is fastened to the bottom flange 78 of the upper screen segment 12*b*. Additional screen segments 12 may then be added to create different shapes for various installation needs. These additional screen segments 12 may include an intermediate screen segment 22 that lengthens the pipe screen as particularly shown in FIG. 5A. Additionally, a middle screen segment 12*c* may be inserted between the lower screen segment 12*a* and upper screen segment 12*b* to make a taller pipe screen 10, as particularly shown in FIGS. 2B and 2C. In this manner, each screen segment 12 is an individual building block wherein the modular pipe screen 10 is comprised of one or more building blocks.

In the preferred embodiment, the screen segments 12 are secured together with fasteners 18 that are inserted into a plurality of orifices 56 within the horizontal mounting surfaces 52. Although the single panels 26, 80 are comprised of a grid structure 32 and a plurality of perforations 34 through which fasteners 18 may be inserted, the orifices 56 are manufactured with a larger diameter than the perforations 34. The orifices are preferably produced using a plasma cut, and it will be appreciated that alternative manufacturing methods can be used for producing the holes, such as being drilled out, laser cut, water-jet cut, or otherwise machined. The orifices 56 allow a larger fastener 18 and more securely join the screen segments 12. Additionally, the preferred fastener 18 is a bolt secured with a washer and nut, but other types of fasteners may be used. These include but are not limited to screws, welds, and bolt and lock fasteners. In addition to forming orifices 56 to fasten the segments 12 together, orifices 56 are also produced along the vertical mounting surface 54 and proximate to the bottom side 30 of the lower screen segment 12*a* wherein anchors 20 secure the modular connecter pipe screen 10 to the catch basin bottom surface 150*a* and side walls 150*b*. However, in another embodiment the perforations 34 act as the orifices 56 and the worker may simply insert fasteners 18 through the perforations 34 without producing larger orifices 56.

Figure 4A:
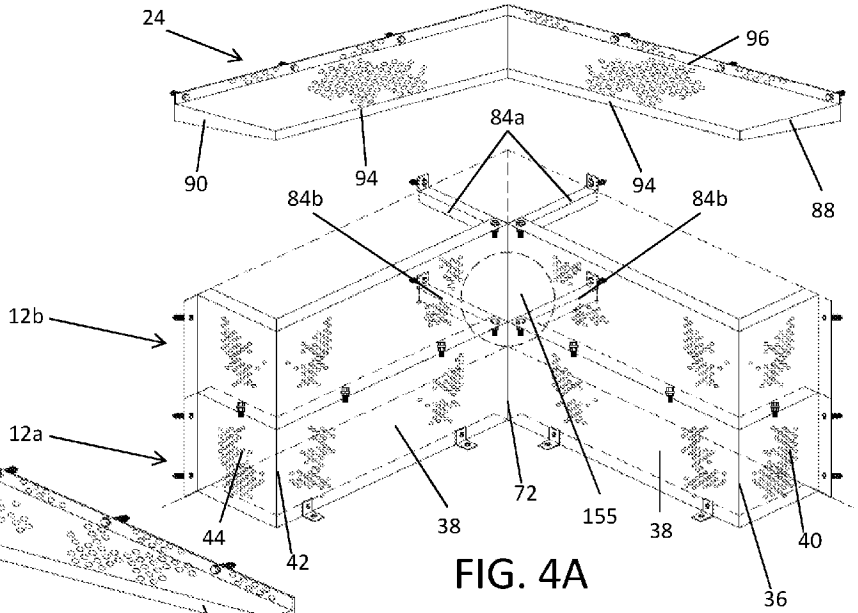
FIG. 4A is an isometric view of a modular connector pipe screen having three bends and a deflector screen.
Figure 4B:
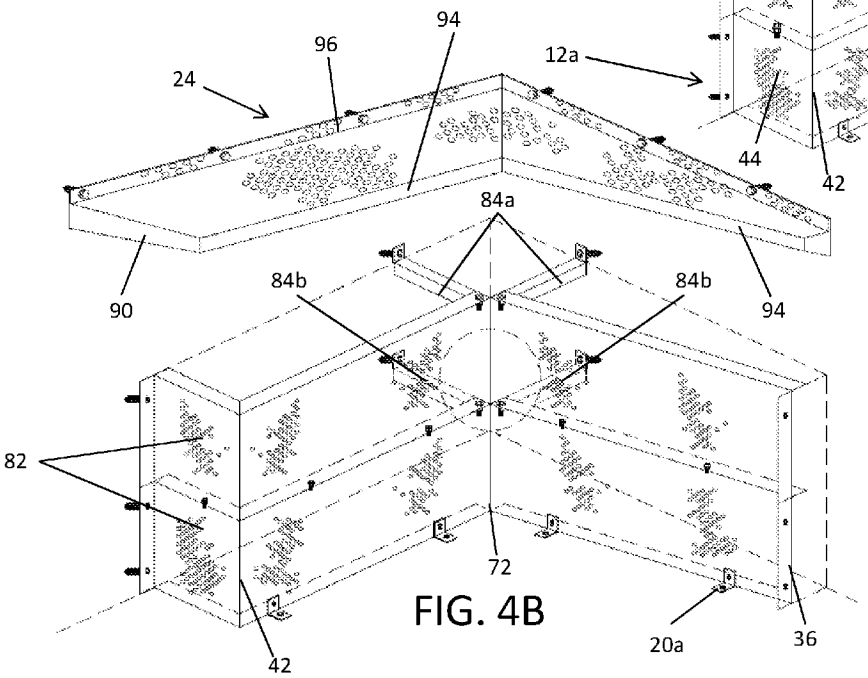
FIG. 4B is an isometric view of a modular connector pipe screen having three bends and a deflector screen, wherein one section angles towards the catch basin side wall.
Figure 5B:
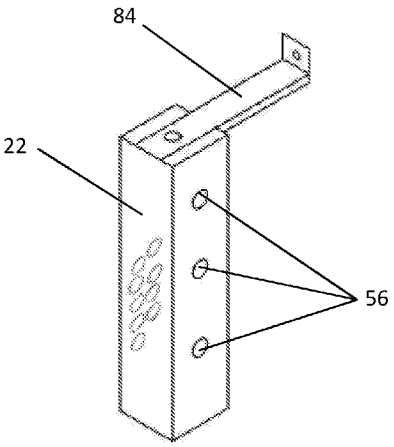
FIGS. 5A and 5B depict an intermediate segment used to connect two modular connector pipe screen segments.
Figure 5A:
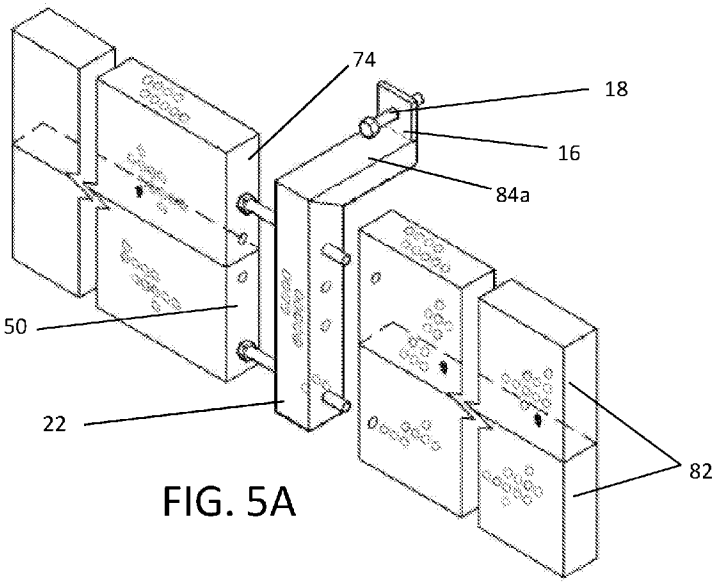
Figure 5C:
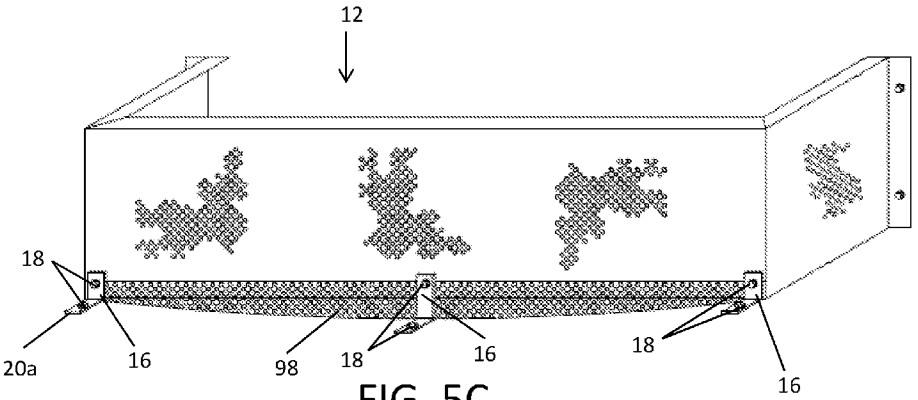
FIG. 5C depicts a screen skirt attached to the bottom side of a modular connector pipe screen segment used in catch basins having uneven bottom surfaces.

In another aspect of the present invention, the lower screen segment 12*a* is attached to the bottom of the catch basin 150*a* through a plurality of brackets 16 and fasteners 18 or other types of anchor mounts 20*a* that are connected to either the bottom flange 46 or the bottom side 30 of the lower screen segment 12*a*. In the preferred embodiment, the side flanges 74 of the upper screen segment 12*b* and the side flanges 50 of the lower screen segment 12*a* are directly attached to the side of the catch basin 150*b* through anchors 20*b* about the vertical mounting surface 54. Additionally, the modular pipe screen 10 may also function in catch basins 150 having uneven bottom surfaces 150*a*. As shown in FIG. 5C, a screen skirt 98 may be fastened to the bottom side 30 of the lower screen segment 12*a* that fills the void between the bottom side 30 of the lower screen segment 12*a* and the uneven surface of the catch basin's bottom 150*a*. To better secure the modular connecter pipe screen 10 to the catch basin walls 150*b*, a worker may elect to use a cross-brace 84. As shown in FIGS. 4A and 4B, at approximately the midpoint of the top flange 76 of the upper screen 12*b*, an upper cross-brace bracket 84*a* or other support bracket preferably connects the upper screen top flange 76 to the catch basin wall 150*b*. In another embodiment, a lower bracket 84*b* or other support bracket connects the top flange 48 of the lower screen segment 12*a* to a side wall of the catch basin 150*b*.

Figure 2A:
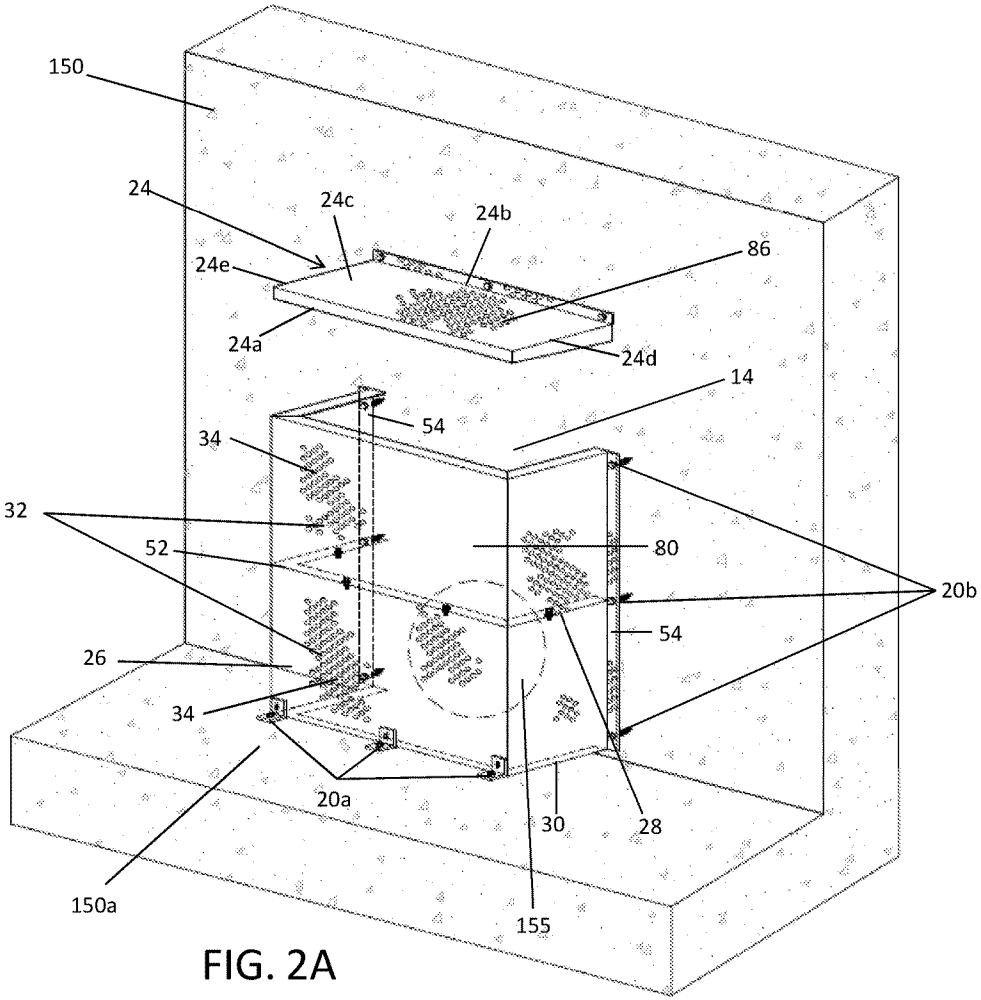
FIG. 2A is an isometric view of a modular connector pipe screen for a catch basin and a deflector screen.
Figure 2C:
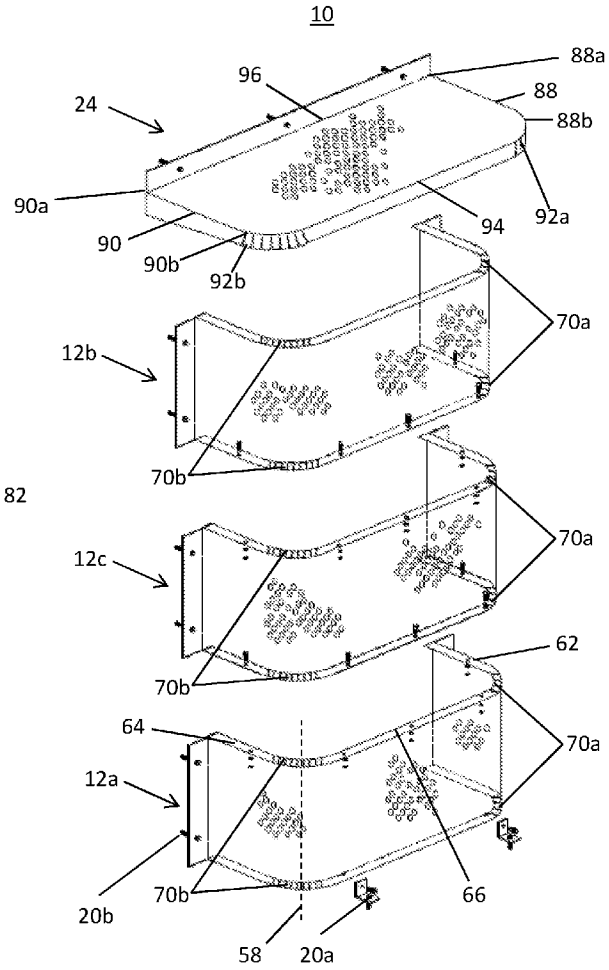
FIG. 2C depicts an exploded view of a modular connector pipe screen for a catch basin having rounded corners and a deflector screen.
Figure 2B:
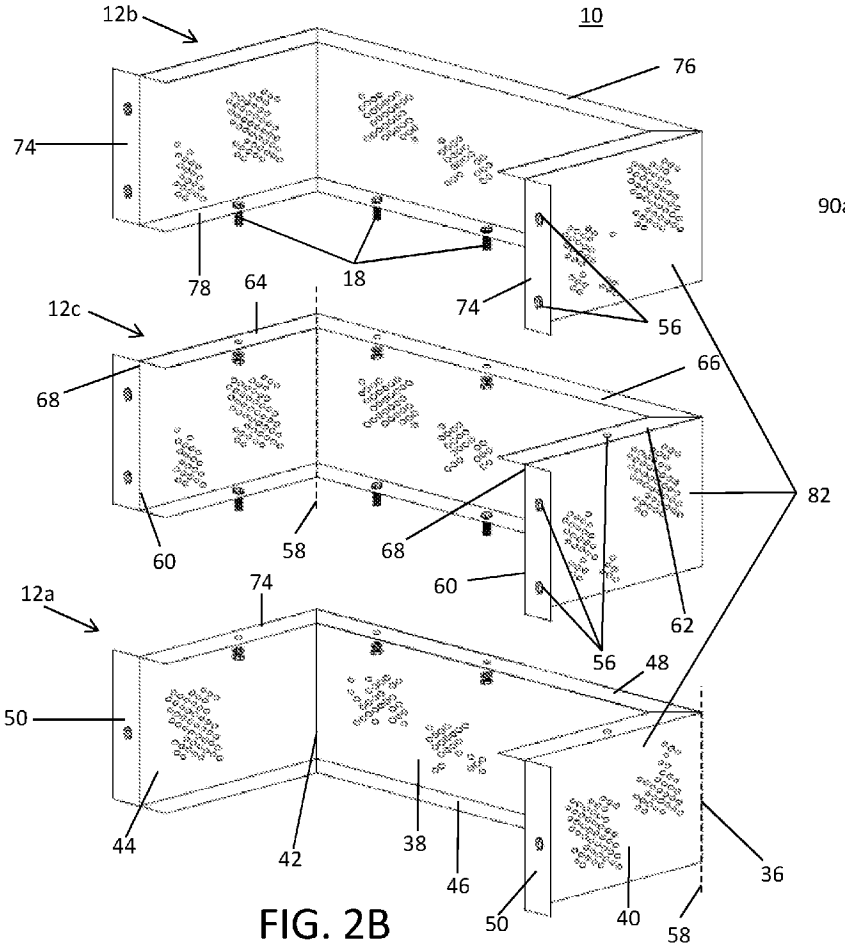
FIG. 2B depicts an exploded view of a modular connector pipe screen for a catch basin having 90° bends.

The bends in the single perforated screen panel of the upper screen segment 12*b* and the lower screen segment 12*a* form a longitudinal axis 58 extending between the lower screen segment's 12*a* bottom flange 46 and the upper screen segment's 12*b* top flange 76 in a substantially perpendicular orientation to the horizontal mounting surface 52 of the plurality of screen segments' 82 top flanges 48, 76 and bottom flanges 46, 78. The longitudinal axis 58 is also substantially parallel to the vertical mounting surface 54 of the plurality of screen segments' 82 side flanges 50, 74 and an interface segment 60 seen at the connection of the side flanges 50, 74 and at least one of the first side section 40 and the second side section 44. In the preferred embodiment shown in FIG. 2, the plurality of screen segments have a first bend 36 between a center section 38 and first side section 40 and a second bend 42 between the center section 38 and a second side section 44. As illustrated, these bends occur about the longitudinal axis 58. It will be appreciated that the shape of the bends 36, 42, 72 do not need to be 90° for every modular design. As shown in FIG. 2C, the screen segments 12 may have a first-fold cut flange interface 70*a* between the first mounting side 62 and the center mounting side 66 and a second-fold cut flange interface 70*b* between a second mounting side 64 and the center mounting side 66. With these fold-cuts 70, the bends 36, 42, 72 along the longitudinal axis 58 are not limited to 90° for every modular design. Additionally, the bends 36, 42, 72 may have a relatively small radius of curvature, such as shown in the accompanying illustrations which are less than 1 inch (<1"), or they may have a larger radius of curvature which can be greater than one inch (>1") which could be on the order of magnitude of a quarter or even half the length of the side sections 40, 44 which would give the screen segment 12 a rectangular shape with rounded corners.

Figure 1A:
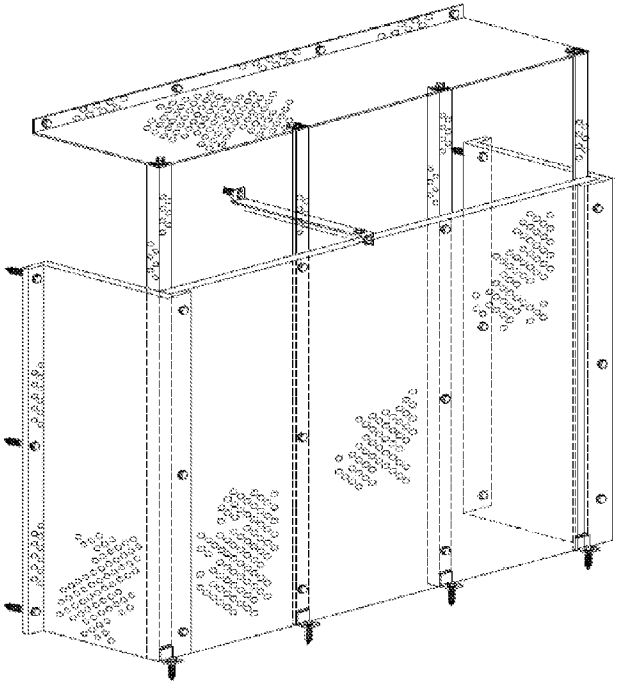
FIG. 1A PRIOR ART
Figure 6B:
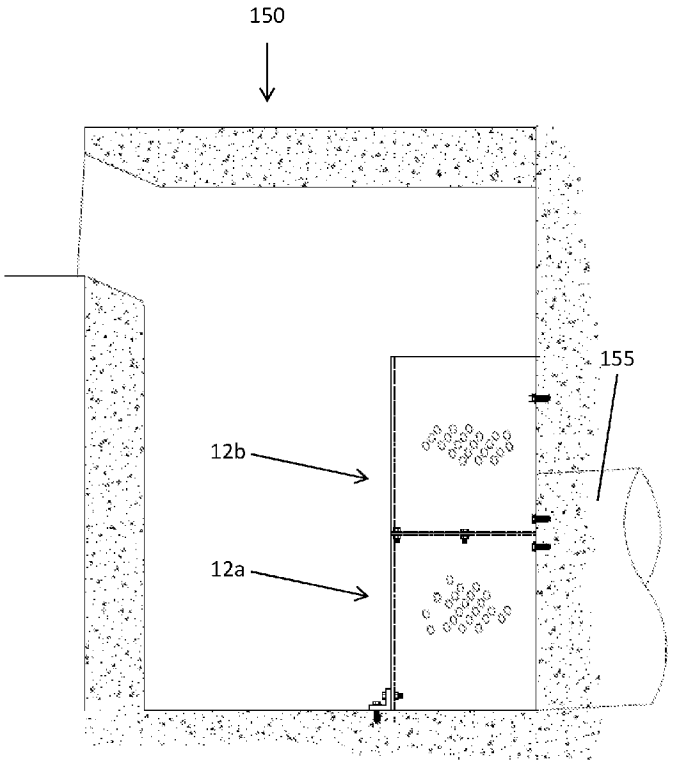
FIG. 6B is a side view of a modular connector pipe screen connected to a catch basin wall opposite from a curb opening.
Figure 6A:
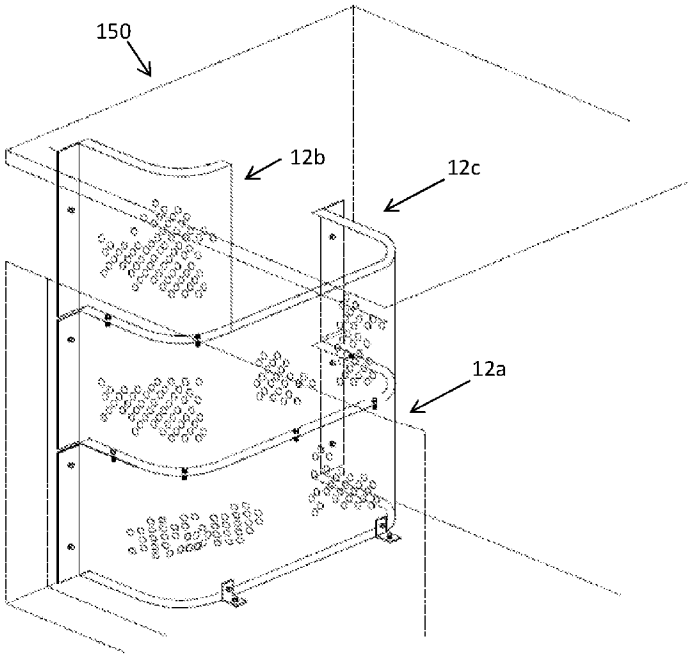
FIG. 6A is an isometric view of a modular connector pipe screen used in a catch basin adjacent to a curb opening where the top segment serves as a side deflector screen.

As generally shown in FIGS. 2A, 2B, 4A, and 4B, connector pipe screens typically have a rectangular shape in a planform view. This rectangular shape had been necessary in prior art designs to accommodate the framed screen systems as shown in FIGS. 1A and 1B. However, with the modular connecter pipe screen 10 of the present invention, the screen segments 12 can have curved surfaces, particularly including the center section 38 and side sections 40, 44 of the screen segments 12. This can allow for a wide variety of curved shapes, including semielliptical, semicircular, arc (such as a circular segment) or quasi-semielliptical shapes. Examples of screen segments 12 with rounded bends between the center section and the side sections are illustrated in FIGS. 2C and 6A.

As indicated above, screen segments' 12 bottom flanges 46, 78 and top flanges 48, 76 have horizontal mounting surfaces 52 that extend inwardly from the side sections 40, 44 and the center section 38 into the interior space 14 of the screen segments 12. The flanges 46, 48, 50, 74, 76, 78 increase the stiffness and rigidity of the modular screen segments 12 which help avoid the need for any frame elements separate from each single perforated screen panel 26, 80 which is used to make each individual screen segment 12. To avoid buckling or overlap of the material at the corners of the screen segments 12, i.e., where the flanges 46, 48, 50, 74, 76, 78 meet with the bends 36, 42, 72 in the screen segments 12, the screen panels 12 preferably include cutout sections 68 between the side mounting surfaces 62,64 and the center mounting surface 66. Naturally, with curved surfaces, other techniques may be used in association with the cutout section 68 or on their own. For example, since the screen segments 12 have perforations 34, it may be possible to perform the bending of the flanges around the curve with a die, or through a rolling operation or any other operation for bending sheet metal. Exotic manufacturing techniques, such as superplastic forming, are generally not required and would likely result in excessive costs for the modular screen segments.

The deflector screen 24 is positioned over the upper screen segment 12*b*, but is not connected to the upper screen 12*b* through any frame element or other structure. Instead, the deflector screen 24 is self-supporting when it is connected to the side of the catch basin 150*b*. Similar to the screen segments 12, the deflector screen 24 is formed from its own single perforated screen panel 86 with a front 24*a*, a back 24*b*, and a top surface 24*c* extending between a first side 24*d* and a second side 24*e*. The deflector screen 24 has a pair of tapered sides 88, 90, each of which tapers from a wider section at the back 88*a*, 90*a* to a narrower section at the front 88*b*, 90*b*. The deflector screen 24 is further comprised of a first side bend 92*a* between the first tapered side 88 and the top surface 24*c* and a second side bend 92*b* between the second tapered side 90 and the top surface 24*c*. There is also a front bend 94 and a back bend 96 that are respectively proximate to the front side 24*a* and the back side 24*b* and which extend between the first side 24*d* and the second side 24*e*.

Although the deflector screen 24 is positioned over the upper screen segment 12*b* in the preferred embodiment, other embodiments do not require a topside deflector screen 24. As depicted in FIG. 6, the modular connector pipe screen of the present invention can be used in catch basins in which the water with debris enters through curb openings. For example, FIG. 6A illustrates a connector pipe screen that is adjacent to a curb opening, and in this embodiment, the top segment 12*b* is only on the curb side of the connector pipe screen so that it serves as a curbside deflector screen. In the embodiment shown in FIG. 6B, the connector pipe screen is positioned against the catch basin wall opposite from the curb opening so no deflector screen is needed in this embodiment.

Figure 7:
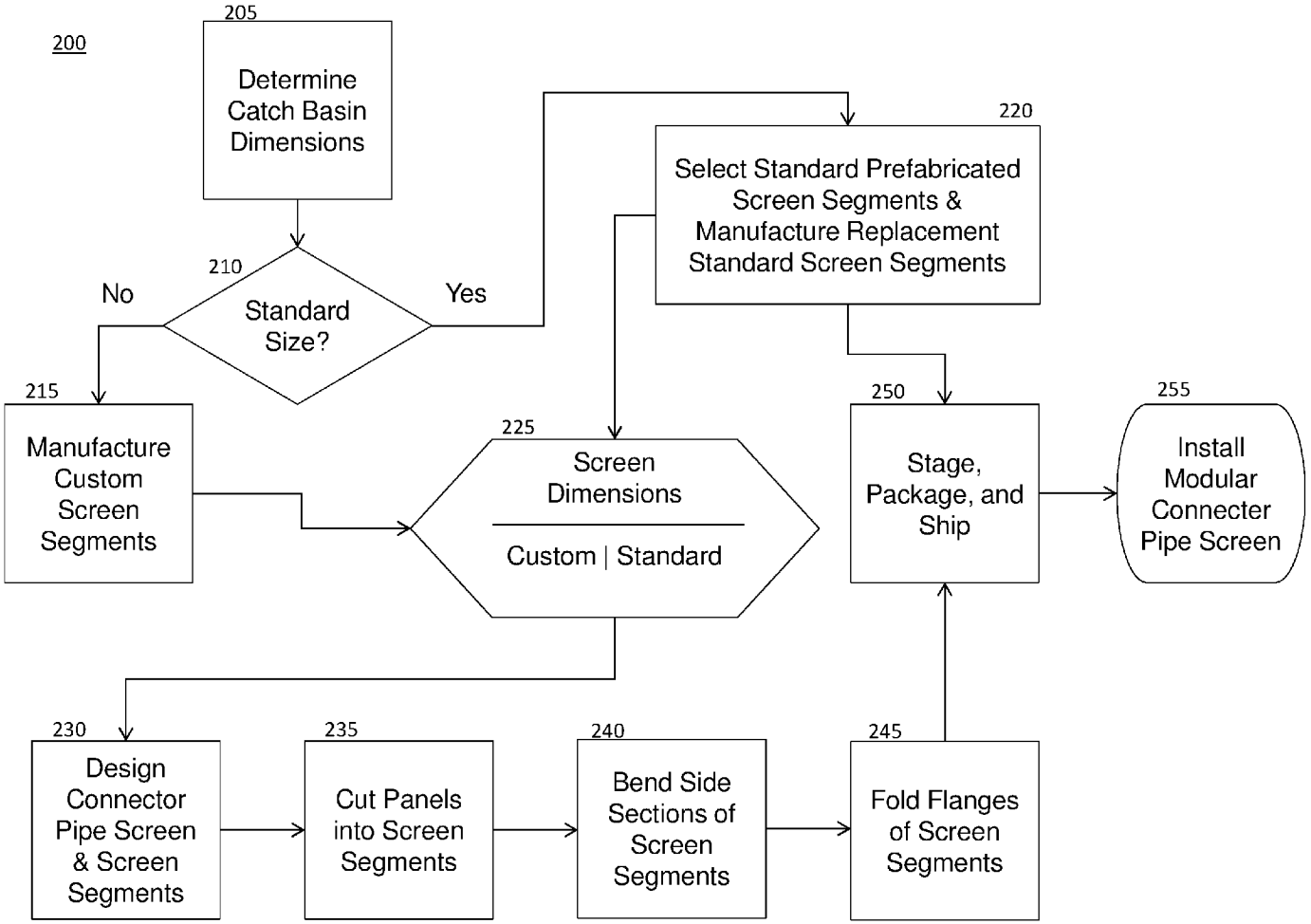
FIG. 7 is a flow chart of the process to manufacture and install the modular connector pipe screen according to the present invention.

The present invention also provides for an inventive manufacturing process 200 for producing the modular connector pipe screen 10 from the perforated screen panel 26, 80. The steps for the manufacturing process 200 are described below with reference to the flowchart shown in FIG. 7. If the dimensions are not known for the catch basin in which the modular connector pipe screen 10 is to be installed, a field worker preferably determines the dimensions 205. In one embodiment, the catch basin may be a standard size, and the modular screen 10 may be selected from pre-formed standard dimensions 220 that fit the standard size catch basin 150. Another embodiment may have a custom 215 modular screen 10 for catch basins of various sizes. Regardless of the embodiment, it is preferable to determine the catch basin 150 dimensions 205 in order to determine 210 if a standard pre-formed pipe screen 220 will fit or if a custom screen should be manufactured 215. To ensure a ready supply of standard pre-formed pipe screen segments, new standard segments are manufactured 220 to replace the standard segments that have been selected for installation.

If the catch basin 150 dimensions are determined 205 to be of a standard size, a worker will simply select one of the prefabricated pipe screens 220 and subsequently stage, pack, and ship 250 the prefabricated pipe screen 220 to the jobsite for installation 255. If a prefabricated 220 pipe screen 10 is not on hand or a custom 215 pipe screen 10 is needed, a worker will begin the design and manufacturing process 225 based on the catch basin dimensions 205. It is an aspect of this method 200 that the manufacturing process 225 may produce modular connector pipe screens 10 of varying dimensions. Preferably, a worker designs 230 the modular connecter pipe screen 10. The design is traditionally completed in a computer aided design ("CAD") program wherein a digital model of the modular connector pipe screen 10 is created. Although a 2D-CAD or 3D-CAD program is the preferred method, other types of designing 230 may be used, including hand drawn models, wire-frame models, and surface models. Of course, it will be appreciated that for standard screen segments and custom-size segments that have been designed previously, the CAD program can have a library of screen segment sizes from which the designer can select.

After a design has been created 230, a single panel 26, 80 of perforated materiel 24 is cut 235 into a planar layout based on the design 230. In the preferred embodiment, the design 230 is transferred into a CAD file readable by a CNC plasma cutting software wherein the single panels 26 are placed onto a CNC plasma cutting table and cut based on the specific design 230. Although a plasma cutting software and table are preferred, the cutting process 235 may vary depending on the available cutting methods. Thus, in another embodiment the single panels 26, 80 may be hand cut based on the hand drawn models of the design 230. Additionally, other CNC software and machine types may be used in the cutting process 235 including but not limited to, laser cutting machines, milling machines, routing machines, lathe machines, waterjet cutting machines and other similar technologies.

After the single panels 26, 80 have been cut 235 to the design specifications, a worker operates a forming machine or other tool to bend 240 the single segments 26, 80 into the modular screen segments 12 used in the connecter pipe screen 10. It will be appreciated that the forming machine may be an automated or robotic system. The modular connector pipe screen 10 will typically have a first bend 36, second bend 42, and third bend 72 about the longitudinal axis 58. The first bend 36 extends between the top side 28 and bottom side 30 at a first location closer to the first end than the second end to form a first side section 40. The second bend 42 extends between the top side 28 and bottom side 30 at a second location closer to the second end than the first end to form a second side section 44. When complete, the first bend 36 and second bend 42 define a center section 38 between the side sections 40, 44. Further, as shown in FIG. 4, a third bend 72 may occur between the top side 28 and bottom side 30 at a third location between the first and second locations to separate the center section 38.

Once the single panels 26, 80 have been bent with any number of sections 38, 40, 44, a worker or automated system folds 245 the top flanges 48, 76 and bottom flanges 46, 78 inwards towards the interior 14, which then act as a horizontal mounting surface 52. Subsequently, the side flanges 50, 74 are folded 245 outwards as a vertical mounting surface 54 and are mountable to the catch basin walls 150*b*. Additionally, the flange folds have a cutout section 68 that is removed from the single screen panels 26, 80 and allow the modular connector pipe screen 10 to not be in conflict in the finished configuration. In another embodiment, shown in FIG. 3, the pipe screen 10 may not have side sections 40, 44 and subsequently not have a first bend 36, second bend 42, or third bend 72. Instead, the screen segment 12 separating the side flange folds 50, 74 defines the center section 38 and no other sections or bends are needed.

Although, the dimensions of the bends and flange folds made during manufacturing 225 are not to be interpreted as limiting and the dimensions may vary in relation to the dimensions of the catch basin 150, standard modular connector pipe screens 10 may have preferred bends and folds as follows. In one embodiment the modular connector pipe screen 10 is squared and has 90° bends 36, 42, 72 about the longitudinal axis 58, as shown in FIG. 2A and FIG. 4. In another embodiment the pipe screen 10 has radial corners, as depicted in FIG. 2C, with a 4" radius on the front side of the screen segments 12. To achieve this radial curve, flange interface fold-cuts 70 are made at the top 28 and bottom 30 of the screen segments 12. In the preferred embodiment the flange interface fold-cut 70 can be a patterned cut (preferably 1.25"×6.28") wherein the fold-cut 70 results in six (6) equally spaced tabs folded into the 4" radius described. Additionally, the top flanges 48, 76 and bottom flanges 46, 78 typically extend 1.25" at a 90° inward fold relative to the screen's inner surface wherein the side sections 40, 44 are between 10" and 12" in length. Further, the side flanges 50, 74 typically extend 1.5" at a 90° outward fold relative to the screen's outer surface.

After the screen segments 12 have been bent 240 and folded 245 to the specifications of the design 230, workers will stage 250 the modular connecter pipe screen 10 with all screen segments 12, brackets 16, fasteners 18 and anchors 20. After staging, workers will package 250 all components for shipping. Finally, field installers will install the modular connector pipe screen 10 in the catch basin 150 in step seven 255.

In describing the apparatus 10 and method 200 of the present invention, a perforated screen 26, 80 is generally identified as the material that is used to produce the screen segments 12 and the deflector screen 24. Persons of ordinary skill in the art will appreciate that there are a number of materials that could be used for the screen 26, 80 and that the particular manufacturing methods may vary. For example, the method described above 200 is preferable for a metal perforated screen, such as a mesh screen, a woven-wire screen, a punched-hole screen, a drilled-hole screen, a profile wire screen, or any other type of metallic screen with perforations or other apertures through the material. Other methods may be more suitable for reinforced plastic screens and screens made from other materials that approach their fluid state at relatively low temperatures (such as compared with the melting temperature of metals). For example, the making of bends with a plastic screen may be performed in combination with the addition of heat at the bending joint or it may be performed in when forming the screen segment in a mold, and cutting out sections of the screen may not even be required for a plastic screen. Accordingly, the most general steps of the manufacturing process 200 are described as making the bends in the modular connector pipe screen 10, and it will be appreciated that any manufacturing technique to make such bends is considered to be within the scope of the present invention regardless of the particular techniques that may be used for different types of materials.

As shown in FIGS. 2, 3 and 4, the shape of connector pipe screens 10 can vary to suit the particular design of different catch basins 150 and the location of the connector pipes 155 and other structures within those catch basins 150. For example, as shown in FIG. 4, a W-shaped connector pipe screen assembly 10 may be most effective for a connector pipe 155 that is installed in the corner of a catch basin 150. In this embodiment, the upper screen segment 12*b* and lower screen segment 12*a* are each preferably formed from a single panel 26, 80 with the center section's 38 front face bent into an L-shape. The side sections 40, 44 are then bent back from each one of the respective faces of the L-shaped center section 38 and the entire panel 26, 80 resembles the shape of a "W" in the planform view. It follows that this embodiment, as illustrated in FIG. 4A, has a total of three bends 36, 42, 72 and four faces. A first bend 36 is between the first side section 40 and a first face of the L-shaped center section 38. A second bend 42 is between the second side section 44 and a second face of the L-shaped center section 38. Finally, a third bend 72 separates the center section 38 into the two separate faces that resemble the shape of an "L". As explained below with regard to FIGS. 5A and 5B, it is also possible to use connector brackets 100 to connect multiple screen segments 12 rather than having a third bend 72. As shown in FIG. 4B, a connector pipe screen assembly 10 may have a taper to provide a clearance space around a ladder or steps that are installed in the catch basin below a manhole to provide workers with ingress and egress.

Additionally, as shown in FIGS. 4A and 4B, multiple cross-brace support brackets 84 can be used. Such brackets 84*a* may connect the top flange 76 of the upper screen segment 12*b* to the catch basin wall 150*b*. Additionally, in some installations, a support bracket 84*b* may be used to connect the lower screen segment 12*a* to the catch basin wall 150*b* from the lower screen segments top flange 48. In prior art designs which have a single screen panel across the entire front face of the screen assembly, it would be difficult to connect a support bracket 84 between a middle section of the screen and the catch basin wall because the upper portion of the screen section blocks direct access to the support bracket. With the modular design of the present invention that uses upper screen segments 12*b* and lower screen segments 12*a*, the lower support bracket 84*b* could be installed with the lower screen segment 12*a* and then the upper screen segment 12*b* could be installed over the lower screen segment 12*a* and lower support bracket 84*b*. Therefore, the worker would have direct access to the support bracket 84*b* and its mounting locations between the catch basin wall 150*b* and the lower screen segment's top flange 48. It follows that once the lower screen segment 12*a* and support bracket 84*b* are mounted, the worker can then mount the upper screen segment 12*b* and upper support bracket 84*a* as described above.

Figure 3B:
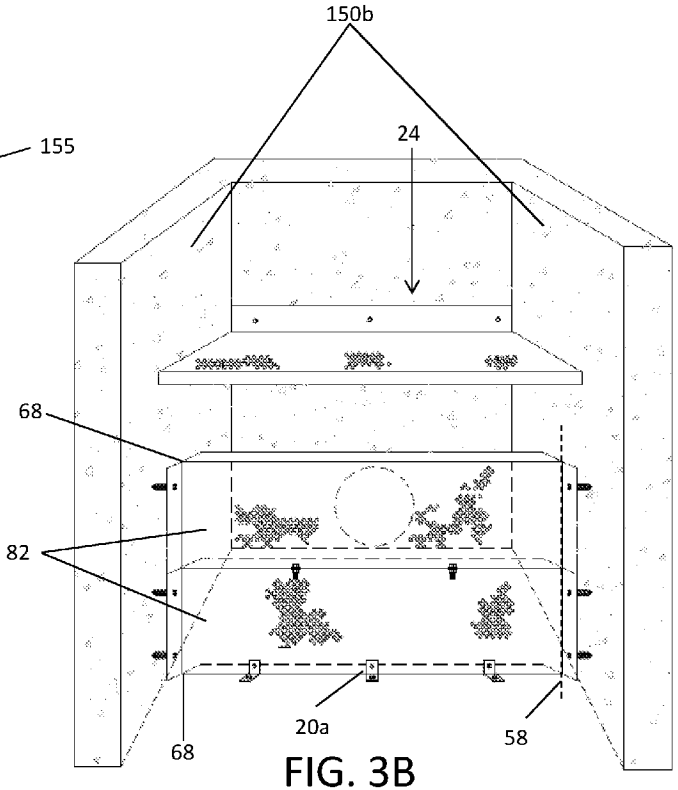
FIG. 3B is a front perspective view of a modular connector pipe screen that extends between side walls of a square catch basin and a deflector screen.
Figure 3A:
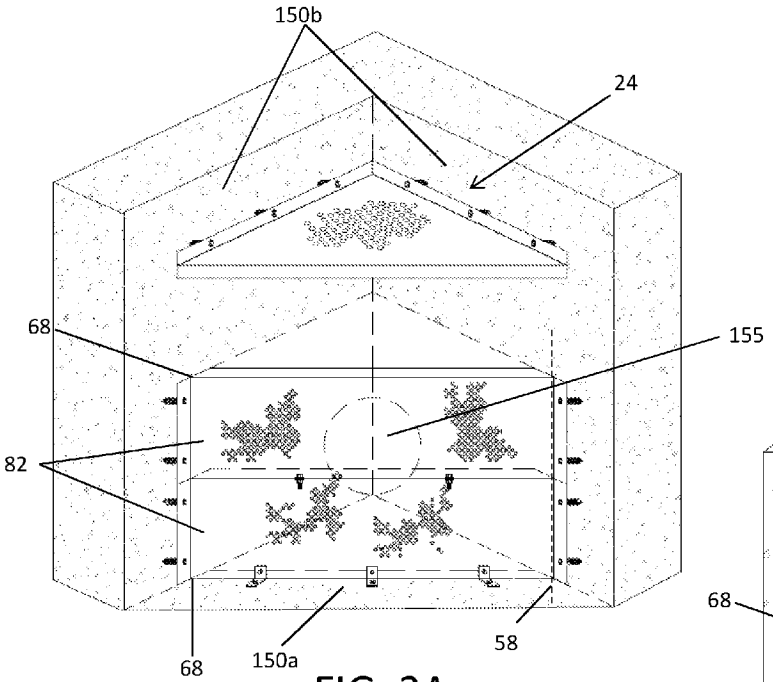
FIG. 3A is a front perspective view of a modular connector pipe screen for a corner catch basin and a corner deflector screen.

An alternative connector pipe screen assembly 10 for a corner-pipe catch basin is shown in FIG. 3A. In this embodiment, the lower screen segment 12*a* and upper screen segment 12*b* each have a center section 38 with top flanges 48, 76, bottom flanges 46, 78, and a pair of side flanges 50, 74. These screen segments 12 do not require side sections 40, 44 that are bent from the center section 38 because the side flanges 50, 74 are attached directly to the catch basin wall 150*a*. Additionally, the side flanges 50, 74 are bent about the longitudinal axis 58 and the cutout section 68 is removed. This embodiment can also be used in a square shaped catch basin 150 wherein the screen segments 12 span the length between the catch basin sidewalls 150*b*. Such a configuration can be seen in FIG. 3B.

The prefabricated modular screen segments 10 of the present invention can replace current framed screen systems for storm drains and other drainage catch basins 150, such as shown in FIG. 1A in the prior art drawing. Similarly, the prefabricated modular screen segments 10 can be used to produce other shapes for different types of screen installations, such as shown in FIG. 1B in the prior art drawing. It is possible for different shapes to be pre-formed as a part of the fabrication process, or intermediate segments 22 may be used with the modular screen segments as shown in FIG. 5A. Although current connectors are typically used primarily to connect flatbed sieve screens, such as disclosed in U.S. Pat. Nos. 4,909,929 and 8,887,922, it will be appreciated that various connector angles could be used other than the 180° connectors which are disclosed in these references. For example, a 90° outer connector or 270° inner connector could be used to connect the long middle sections to create a screen design as shown in FIG. 2. A range of angles are also possible, such as 45°, 60°, 120°, 135°, and others. It will be appreciated that although the '929 Patent and '922 Patent disclose a connector system for connecting flatbed sieve screens, these patents are also framed screen systems because they require framework in addition to the connectors. According to the present invention, although there may be intermediate segments 22 to allow for installations with different shapes, there is no framework used in connecting the prefabricated modular screen segments 12. As evident from the prior art references, a framework extends along an entire length of a screen panel and is overlaid by the screen panel even when the screen assembly is formed by multiple screen segments with connectors.

According to the innovations of the present invention, there is no need for any framework even when screen assemblies 82 are formed using screen segments 12 and intermediate segments 22. As shown in the drawings and as described above, each one of the screen segments 12 has side flanges 50, 74 as well as top flanges 48, 76 and bottom flanges 46, 78, and these flanges can be used to attach intermediate segments 22. Intermediate segments 22 that connect adjacent screen segments 12 are particularly shown in FIG. 5A. In FIG. 5A, adjacent screen segments 12 are connected with a single screen intermediate segment 22 that is made of the same material as the adjacent screen segments 12. In the preferred embodiment, the intermediate segment 22 is 3-sided, having a center section 38 and a pair of side flanges 50, 74, and spans the entire height of the screen assembly 82. The intermediate segment 22 also has a top flange 48, 76 and is open on the interior 14. It will be appreciated that individual intermediate segments 22, as seen in FIG. 5B, could be used in a stacked configuration rather than a single intermediate segment 22 that is connected from the lower screen segments bottom side 30 to the upper screen segments top flange 76. Stacked intermediate segments 22 would have the same height as the screen segments 82 and would preferably include a bottom flange 46, 78 for connecting the stacked intermediate segments 22 to each other, similar to the screen segments 12 themselves. Additionally, the intermediate segments 22 may have cross-braces 84 connecting them to a side wall of the catch basin 150*a*.

Figure 5E:
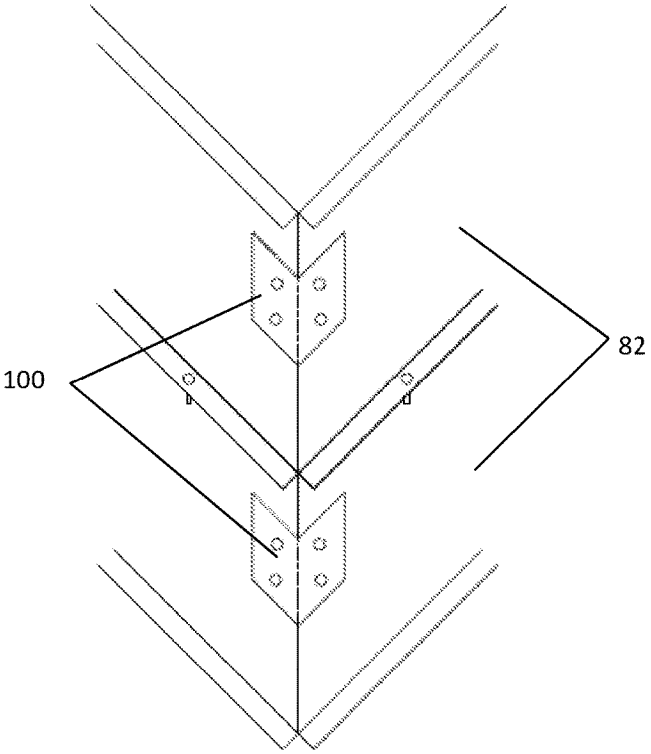
FIGS. 5D and 5E depict an angle bracket being used to secure two corner sections of a modular connector pipe screen.
Figure 5D:
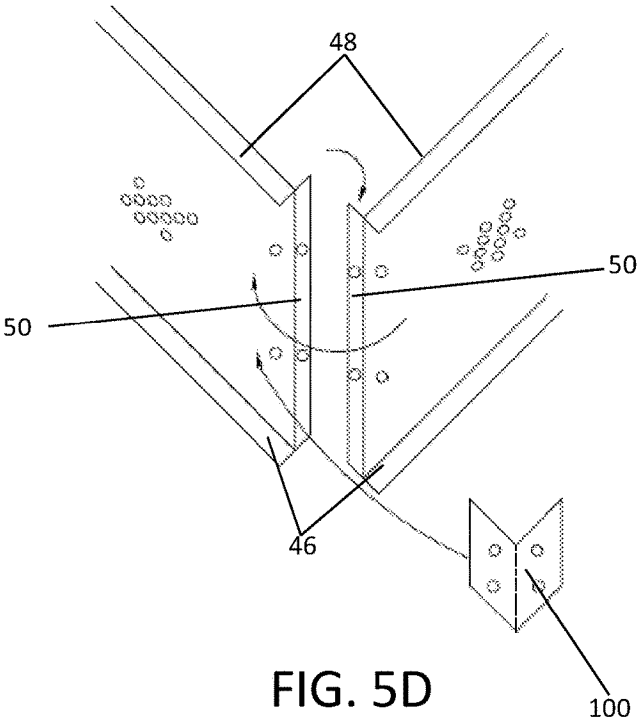

In FIGS. 5D and 5E, side flanges 50, 74 are shown connecting adjacent screen segments 12. For the L-shaped screen, side flanges 50, 74 can be bent at an angle to connect directly to each other or may be bent at angles that allow for connection to the front faces of the adjacent screen segments 12. In particular, the side flange 50, 74 for one screen segment 12 connects to the adjacent screen segment 12 at the front side and the side flange 50, 74 extending from the adjacent screen segment 12 connects to the back side of the other screen segment 12. An optional angle bracket 100 may also be used to connect the adjacent screen segments 12. It will be appreciated that side flanges 50, 74 could be connected directly to each other without any angle bracket 100 between them for any one of the screen assemblies 10.

In the preferred embodiments, the height of the upper screen segment 12*a* and lower screen segment 12*b* are equal ($H_u$=$H_l$) and are one-half the screen assembly's 10 height ($H_s$), i.e., $H_u$=$H_s$/2, $H_l$=$H_s$/2. The height of the lower screen segment 12*a* may be shorter than the height of the upper screen segment 12*b* which will further increase the stiffness and strength of the lower prefabricated screen segment 12*a*, i.e., $H_l$<$H_u$. It will also be appreciated that one or more middle screen segments 12*c* can be stacked between the upper screen segment 12*b* and lower screen segment 12*a* to produce a higher screen assembly 10. Similarly, for a given screen assembly 10 height, shorter screen segments could be used if there is a desire to use middle screen segments 12*c* ($H_u$=$H_s$/N, $H_l$=$H_s$/N. $H_m$=$H_s$/N, where N=Number of Screen Segments). Thus, the breadth and scope of the present invention should not be limited by any of the above-described exemplary embodiments, but should be defined only in accordance with the following claims appended hereto and their equivalents.

The embodiments of the modular connector pipe screen 10 were chosen and described to best explain the principles of the invention and its practical application to persons who are skilled in the art. Generally, screen segments 12 are produced with upper and lower flanges so that they can be fastened together to produce connector pipe screens that allow the flow of water while blocking debris from entering storm drains or similar drainage pipes. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting.

The present invention has additional advantages over the traditional connector pipe screens which require a separate structural members apart from the screens that serve as a framework for the prior art screens. In comparison, in the present invention, the upper screen segment 12*b* and lower screen segment 12*a* with a flange between the segments 12 increases the stiffness and strength of the overall screen assembly 10. As persons of skill in the art will appreciate, this increased strength and stiffness at the bottom of the screen assembly is particularly beneficial because the water pressure is greatest at the bottom of the catch basin 150. Current screen systems do not provide any such additional strength, and if they did, it would likely require either denser screening or more screening which could negatively impact the flow of the water or more frame elements for additional structural support which would increase the material costs and installation time for the framed screen systems.

What is claimed is:

1. A modular connector pipe screen for a catch basin, comprising:

a lower screen segment comprised of a single panel having a top side and a bottom side, wherein the single panel is comprised of a grid structure with a plurality of perforations and having a first bend between a center section and a first side section and a second bend between the center section and a second side section, wherein the center section, the first side section, and the second side section are further comprised of a bottom flange and at least one additional flange selected from the group of flanges consisting of a top flange and a side flange, wherein at least one of the top flange and the side flange are integrally formed with at least one of the center section, the first side section, and the second side section, and wherein the first side section, the center section, and the second side section are all integrally formed with the single panel without any vertical framework structure or fastener; and an interior space between the center section, the first side section, and the second side section, wherein the top flange and the bottom flange are each comprised of a horizontal mounting surface extending inwardly into the interior space from the bottom side and the top side, respectively, and wherein the side flange is comprised of a vertical mounting surface extending outwardly away from the interior space from at least one of the first side section and the second side section.

2. The modular connector pipe screen of claim 1, wherein the horizontal mounting surface and the vertical mounting surface are each further comprised of the grid structure with the plurality of perforations and a plurality of orifices in the grid structure, wherein the orifices are larger than the perforations, wherein the first bend and the second bend each has a longitudinal axis extending between the bottom flange and the top flange in a substantially perpendicular orientation to the mounting surface of the bottom flange, and wherein the longitudinal axis is substantially parallel to an interface segment of the panel between the side flange and at least one of the first side section and the second side section.

3. The modular connector pipe screen of claim 1, wherein the horizontal mounting surface is further comprised of a first mounting surface extending from the first side section, a second mounting surface extending from the second side section, and a center mounting surface extending from the center section.

4. The modular connector pipe screen of claim 3, wherein the single panel is further comprised of a first fold-cut flange interface between the first mounting surface and the center mounting surface and a second fold-cut flange interface between the second mounting surface and the center mounting surface.

5. The modular connector pipe screen of claim 1, wherein the bottom flange, the top flange, and the side flange are each formed from the single panel without any framework structure or fastener connecting the bottom flange and the top flange to the center section, the first side section, or the second side section and without any framework structure or fastener connecting the side flange to the first side section or the second side section.

6. The modular connector pipe screen of claim 1, wherein the center section is further comprised of a third bend between the first bend and the second bend.

7. The modular connector pipe screen of claim 1, further comprising:

an upper screen segment having a pair of side flanges, an upper screen top flange, and an upper screen bottom flange, wherein the upper screen segment is comprised of a single perforated panel corresponding with the lower screen and having a plurality of sections integrally formed with the single perforated panel without any vertical framework structure or fastener; and a plurality of fasteners connecting the upper screen bottom flange to the top flange of the lower screen segment.

8. The connector pipe screen of claim 7, further comprising:

a plurality of brackets;

a plurality of fasteners connecting the brackets to the bottom side of the lower perforated screen segment;

a first set of anchors connecting the plurality of brackets to a bottom surface of the catch basin; and a second set of anchors connecting the side flange to a side surface of the catch basin.

9. The modular connector pipe screen of claim 7, further comprising an upper bracket connecting the upper screen top flange of at least one of the sections to a side surface of the catch basin.

10. The modular connector pipe screen of claim 9, further comprising a lower bracket connecting the top flange of the center section of the lower screen segment to a side surface of the catch basin.

11. The modular connector pipe screen of claim 7, further comprising:

a second lower screen segment;

a second upper screen segment;

an intermediate segment, wherein the intermediate segment connects at least one of the lower screen segment to the second lower screen segment and the upper screen segment to the second upper screen segment, and wherein the intermediate segment is connected through the side flanges.

12. The modular connector pipe screen of claim 11, wherein the intermediate segment extends from the bottom side of the lower screen segment to the upper screen top flange and connects the lower screen segment to the second lower screen segment and connects the upper screen segment to the second upper screen segment.

13. The modular connector pipe screen of claim 11, further comprising a second intermediate segment, wherein the intermediate segment is connected between the top flange and the bottom flange of the lower screen segment, and wherein the second intermediate segment is connected between the upper screen top flange and the upper screen bottom flange.

14. The modular connector pipe screen of claim 7, further comprising a deflector screen positioned over the upper screen segment, wherein the deflector screen is formed from a perforated screen panel separate from the lower screen segment and the upper screen segment, wherein the deflector screen has a front, a back, and a top surface extending between a first side and a second side, and wherein the deflector screen is comprised of a first tapered side tapering from a first wider section at the back to a first narrower section at the front, a second tapered side tapering from a second wider section at the back to a second narrower section at the front, a first side bend between the first tapered side and the top surface along the first side, a second side bend between the second tapered side and the top surface along the second side, a front bend proximate to the front side and extending between the first side and the second side, and a back bend proximate to the back side and extending between the first side and the second side.

15. A modular connector pipe screen for a catch basin, comprising:

a plurality of screen segments, wherein each one of the screen segments is comprised of a single panel having a top side and a bottom side, wherein the single panel is comprised of a grid structure with a plurality of perforations and having a first bend between a center section and a first side section and a second bend between the center section and a second side section, wherein the center section, the first side section, and the second side section are further comprised of a bottom flange and at least one additional flange selected from the group of flanges consisting of a top flange and a side flange, and wherein the first side section, the center section, and the second side section are all integrally formed with the single panel without any vertical framework structure or fastener;

a first set of fasteners, wherein the fasteners connect the top flange of a first one of the screen segments to the bottom flange of a second one of the screen segments, wherein the first one of the screen segments is positioned beneath the second one of the screen segments; and an interior space between the center section, the first side section, and the second side section of the first one of the screen segments and the second one of the screen segments, wherein the top flange and the bottom flange are each comprised of a horizontal mounting surface extending inwardly into the interior space from the bottom side and the top side, respectively, and wherein the side flange is comprised of a vertical mounting surface extending outwardly away from the interior space from at least one of the first side and the second side.

16. The modular connector pipe screen of claim 15, wherein the bottom flange, the top flange, and the side flange for each one of the screen segments are formed from the single panel without any framework structure or fastener connecting the bottom flange and the top flange to the center section, the first side section, or the second side section and without any framework structure or fastener connecting the side flange to the first side section or the second side section.

17. The modular connector pipe screen of claim 16, further comprising:

a plurality of brackets;

a second set of fasteners connecting the brackets to the bottom side of the lower perforated screen segment;

a first set of anchors connecting the plurality of brackets to a bottom surface of the catch basin; and a second set of anchors connecting the side flange to a side surface of the catch basin.

18. A modular connector pipe screen for a catch basin, comprising:

a lower perforated screen segment comprised of a first single panel having a first top side, a first bottom side, and a first pair of side edges, wherein a first top flange extends from the first top side, a first bottom flange extends from the first bottom side, and a first pair of side flanges extend from the first pair of side edges, wherein the first top flange, the first bottom flange, and the first pair of side flanges are all integrally formed with the first single panel without any framework structure or fastener;

an upper perforated screen segment comprised of a second single panel having a second top side, a second bottom side, and a second pair of side edges, wherein a second top flange extends from the second top side, a second bottom flange extends from the second bottom side, and a second pair of side flanges extend from the second pair of side edges, wherein the second top flange, the second bottom flange, and the second pair of side flanges are all integrally formed with the second single panel without any framework structure or fastener; and a first set of fasteners connecting the first perforated screen segment to the second perforated screen segment, wherein the first set of fasteners connect the first top flange of the lower perforated screen segment to the second bottom flange of the upper perforated screen segment.

19. The modular connector pipe screen of claim 18, wherein the first single panel and the second single panel are each further comprised of a first bend between a center section and a first side section, a second bend between the center section and a second side section, a first fold-cut flange interface at the first bend, and a second fold-cut flange interface at the second bend, wherein the first single panel and second single panel are each further comprised of an interior space between the center section, the first side section and the second side section, and wherein the first side section, the center section, and the second side section are all integrally formed with the respective first single panel and second single panel without any vertical framework structure or fastener.

20. The modular connector pipe screen of claim 19, further comprising:

a plurality of brackets;

a second set of fasteners connecting the brackets to the first bottom side of the lower perforated screen segment;

a first set of anchors connecting the plurality of brackets to a bottom surface of the catch basin;

a second set of anchors connecting the side pair of side flanges and the second pair of side flanges to a side surface of the catch basin; and a middle perforated screen segment.

* * * * *